US006935885B2

(12) United States Patent
Scherer et al.

(10) Patent No.: US 6,935,885 B2
(45) Date of Patent: Aug. 30, 2005

(54) CONNECTOR WITH PIERCING CONTACT

(75) Inventors: Heinz Scherer, Bensheim (DE); Markus Strelow, Moerlenbach (DE); Elke Werner, Darmstadt (DE); Andreas Woeber, Kronau (DE); Guenter Feldmeier, Lorsch (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/723,088

(22) Filed: Nov. 26, 2003

(65) Prior Publication Data

US 2004/0157485 A1 Aug. 12, 2004

(30) Foreign Application Priority Data

Dec. 6, 2002 (DE) ..... 102 57 045

(51) Int. Cl.[7] ..... H01R 4/24
(52) U.S. Cl. ..... 439/409; 439/417; 439/425
(58) Field of Search ..... 439/716, 11–23, 439/395–425, 492; 174/88 R; 339/99 R, 94 M; 29/886

(56) References Cited

U.S. PATENT DOCUMENTS 3,720,778 A * 3/1973 Woertz et al. ..... 174/59

FOREIGN PATENT DOCUMENTS

CH 662 906 A 10/1987
WO WO00/62377 A 10/2000

* cited by examiner

*Primary Examiner*—Alexander Gilman
(74) *Attorney, Agent, or Firm*—Barley Snyder LLC

(57) ABSTRACT

The present invention provides a connector for contacting the conductors of a cable. The connector includes a receptacle for receiving the cable and a contacting device which may be placed on the receptacle and which comprises at least one piercing contact for contacting a conductor of the cable. The contacting device is adapted to be placed on the receptacle such that the piercing contact comes to lie in a freely selectable position in the receptacle, in order to contact the conductor of the cable received in the receptacle.

2 Claims, 4 Drawing Sheets

CONNECTOR WITH PIERCING CONTACT

FIELD OF THE INVENTION

The invention relates to a connector having at least one piercing contact for contacting the conductors of a cable.

BACKGROUND OF THE INVENTION

For solderless contacting of the conductors of a cable, connectors are used which produce an electrical contact by means of various connection methods, for example crimping or insulation displacement methods. Connectors are also known which allow contacting of a cable by penetration methods. These connectors comprise one or more pointed piercing contacts in the form of lances or spikes, which, upon connection of the connector to a cable, penetrate the insulation and sheath of the conductor(s) and contact the conductor(s), so avoiding prior removal of the insulation from the conductor(s). Contacting may also be effected at any desired point of a cable, without cutting the cable open at the contact point, such that a plurality of connectors equipped with piercing contacts may be fitted to a cable.

An important prerequisite for connection of a cable via piercing contacts, however, is the precise position of a conductor relative to a piercing contact. Since a connector constitutes a component of predetermined form, it is consequently only suitable for connection to a corresponding standard cable. For this reason, to contact different cables which have the same number of conductors but different conductor spacing, different connectors have to be used. It is also disadvantageous that individual conductors of a multi-core cable cannot be selectively contacted with a connector.

An object of the present invention is to provide a more flexible connector, which in particular allows contacting of different cables.

This and other objects of the invention are achieved with a connector according to claim 1. Advantageous further developments are indicated in the dependent claims.

SUMMARY OF THE INVENTION

The connector according to the invention comprises a receptacle for receiving a cable and a contacting device having at least one piercing contact, wherein the contacting device may be positioned on the receptacle in such a way that the piercing contact comes to lie in a variable position in the receptacle. This makes it possible to contact conductors of differently shaped cables with just one connector. Individual conductors of a multi-core cable may also be electrically connected selectively using a piercing contact.

In a particularly advantageous development of the connector, provision is made for the contacting device to comprise a plurality of piercing contacts arranged in a line with constant spacing, which contacts allow contacting of a corresponding number of equally spaced conductors of a ribbon cable. The line of piercing contacts may be so oriented relative to the receptacle and thus to the cable that the distance between the piercing contacts perpendicular to the cable matches exactly the distance between the conductors of the cable. This makes it possible to contact ribbon cables with different spacing patterns with just one connector.

In another preferred embodiment, the contacting device is in two parts and comprises a holder, which may be positioned on the receptacle in a predetermined position, and a rotary unit mounted rotatably in the holder and provided with piercing contacts arranged in a line with constant spacing. In this embodiment, contacting of a cable is effected very simply and quickly, since the rotary unit is oriented in a desired position in the holder and the latter is then positioned on the receptacle.

Furthermore, it is preferable for the contacting device to have markings which identify particular positions of the rotary unit relative to the holder and thus particular conductor spacings of a ribbon cable, so making possible quick contacting of the cable without prior adjustment of the rotary unit to a conductor spacing.

The contacting device preferably also comprises a latching means, which fixes the rotary unit in particular positions in the holder. In this way, the risk is prevented of imprecise positioning of the rotary unit or slippage of the rotary unit out of a particular position during the contacting process and of associated miscontacting.

BRIEF DESCRIPTION OF THE DRAWINGS

The invention is explained in more detail below with reference to the Figures, in which.

DETAILED DESCRIPTION OF THE INVENTION

Figure 1:
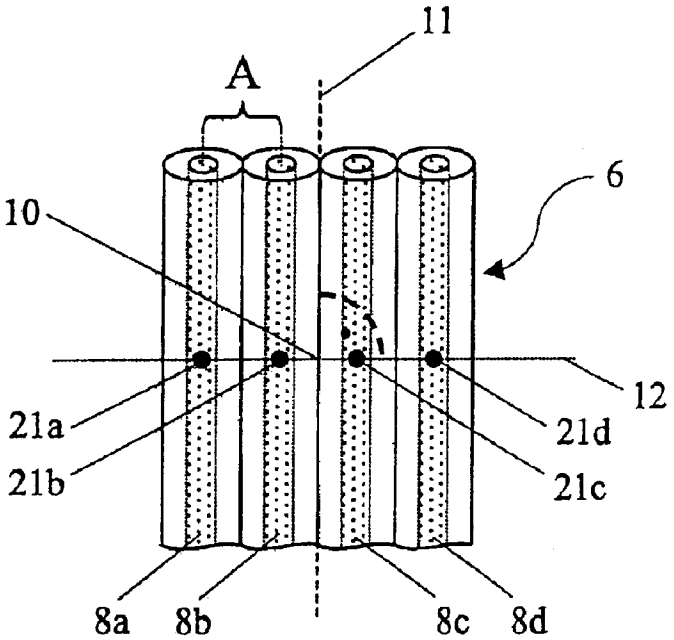
FIG. 1 is a schematic view of a line of constantly spaced piercing contacts, which each contact one conductor of a multi-core ribbon cable.

FIG. 1 is a schematic representation, in plan view, of a line of four piercing contacts 21*a* to 21*d* arranged next to one another with constant spacing and which each contact a conductor 8*a* to 8*d* of a four-core ribbon cable 6. To establish a reference system which also applies to the subsequent Figures, the longitudinal axis of the ribbon cable 6 is designated 11 while a transverse axis perpendicular thereto is designated 12.

The individual conductors 8*a* to 8*d* of the ribbon cable 6 exhibit a spacing A. Since this spacing A corresponds to the mutual spacing of the piercing contacts 21*a* to 21*d*, the line of piercing contacts 21*a* to 21*d* is oriented perpendicularly to the cable 6 on the transverse axis 12.

Figure 2:
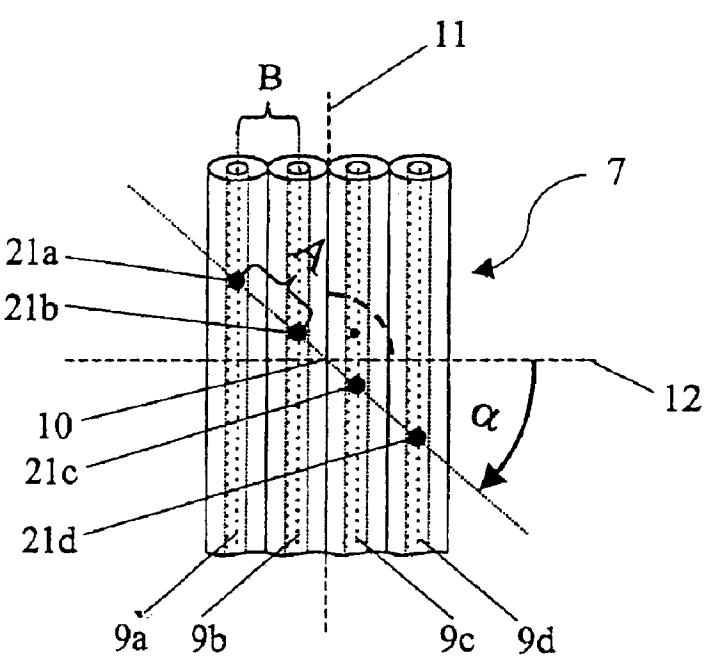
FIG. 2 is a further schematic plan view of the line of piercing contacts, which, rotated by an angle, contact the conductors of a ribbon cable with smaller conductor spacing.
Figure 6:
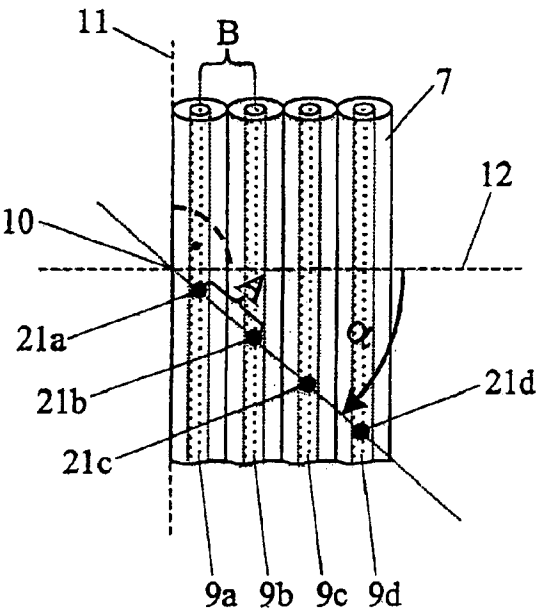
FIG. 6 is a schematic plan view, corresponding to FIG. 2, of the piercing contacts rotated by an angle and arranged over the narrower ribbon cable, wherein the axis of rotation is oriented with lateral offset relative to the piercing contacts

FIG. 2 is a further schematic representation, in plan view, of a line of piercing contacts 21*a* to 21*d* which contact the conductors 9*a* to 9*d* of a ribbon cable 7 exhibiting a smaller conductor spacing B than the spacing A of the piercing contacts 21*a* to 21*d*. So that each of the piercing contacts 21*a* to 21*d* comes to lie over one of conductors 9*a* to 9*d*, the line of piercing contacts 21*a* to 21*d* is rotated by an angle a relative to the transverse axis 12 of the ribbon cable 7. The axis of rotation 10, about which the piercing contacts 21*a* to 21*d* are rotated, is fixed, in the Figure illustrated, by the point of intersection of longitudinal and transverse axes 11 and 12 of the ribbon cable 7 and extends centrally between the piercing contacts 21*a* to 21*d* perpendicularly to the plane common to the two axes 11 and 12. It is possible, of course, to orient an axis of rotation to the side of the piercing contacts, as shown in FIG. 6, for example.

By rotating a line of constantly spaced piercing contacts, it is possible to make the spacing of the piercing contacts perpendicular to a ribbon cable match the spacing between the conductors of the cable. The spacing of the piercing contacts across the ribbon cable is dependent on the selected angle of rotation $\alpha$. With an angle of rotation of 90°, the line of piercing contacts is arranged in the direction of the longitudinal axis, such that, provided that the axis of rotation is arranged over a conductor, only said conductor may be contacted.

Figure 3:
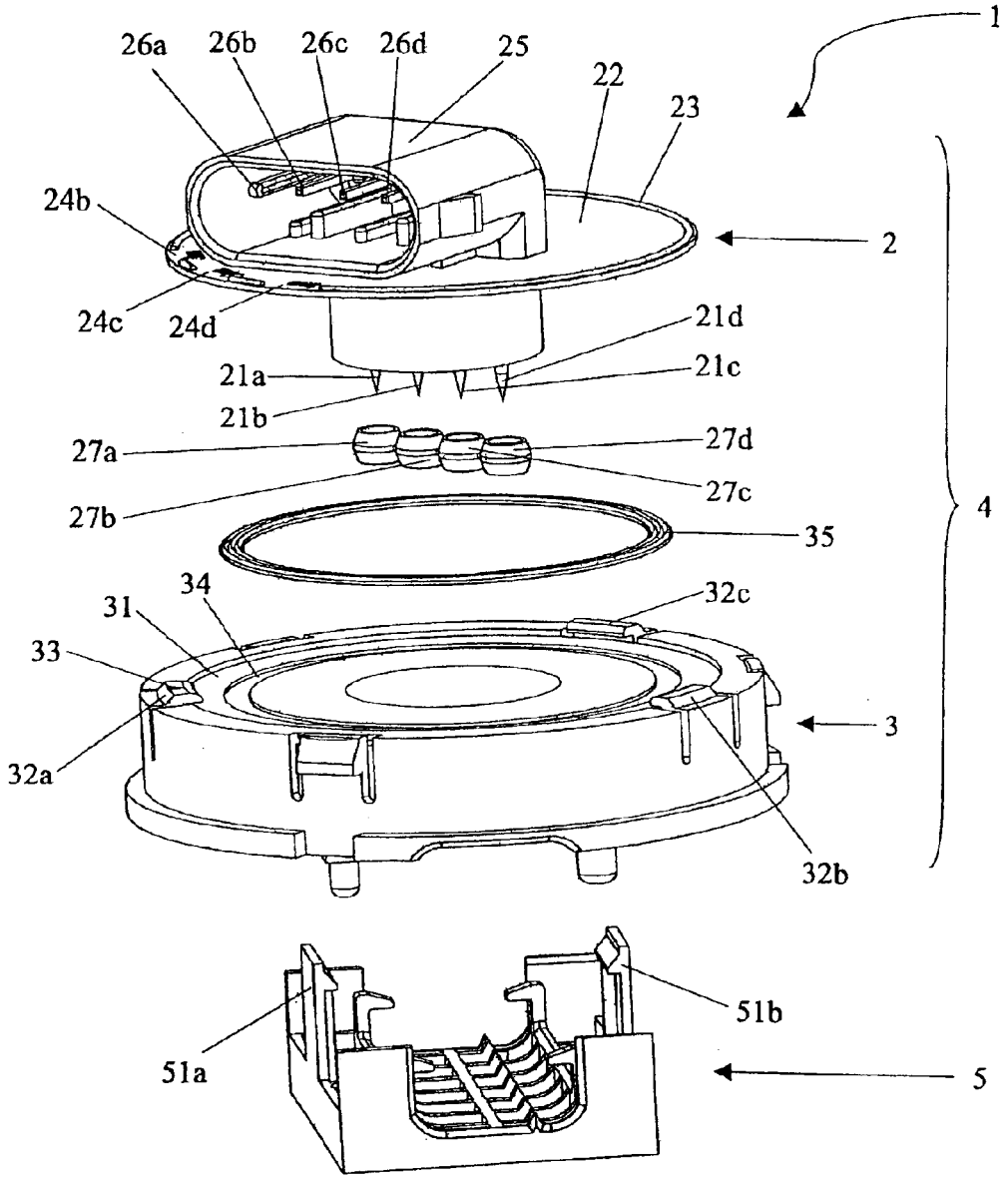
FIG. 3 is a perspective exploded representation of the components of an embodiment of a connector according to the invention.

FIG. 3 is a perspective representation of the components of an embodiment of a connector 1 according to the invention. The connector 1 has a contacting device 4 constructed in two parts, with a rotary unit 2 and a holder 3. The rotary unit 2 is provided with four piercing contacts 21*a* to 21*d*, which take the form of pointed spikes. Such piercing contacts are particularly suitable for contacting the commonly used stranded conductors, whose wires are pushed apart by the piercing contacts upon penetration of a conductor so as to achieve contacting. Furthermore, connectors are of course feasible which have more or fewer than the four piercing contacts 21*a* to 21*d* illustrated.

The piercing contacts 21*a* to 21*d* are in turn connected with plug contacts 26*a* to 26*d* of a plug 25 on the top of the rotary unit 2. An electrical connection may be produced at this point by means of a cable with corresponding socket contacts of a socket.

The rotary unit 2 also has a circular bearing surface 22, by means of which the rotary unit 2 is rotatably mounted in a corresponding recess 31 in the holder 3. To seal the holder 3 relative to the rotary unit 2, the recess 31 in the holder 3 is provided with an additional annular depression 34, into which a correspondingly shaped sealing ring 35 may be inserted against the penetration of dirt and water. Corresponding protection of the piercing contacts 21*a* to 21*d* is provided by cylindrical seals 27*a* to 27*d* surrounding them.

Resiliently fitted clips 32*a*, 32*b*, 32*c* are arranged at the edge of the holder 3 and lock the bearing surface 22 of the rotary unit 2, once inserted, in such a way that the rotary unit 2 can only be rotated relative to the holder 3. Furthermore, a latching means is provided for user-friendly and secure adjustment of the contacting device 4 to particular conductor spacings, corresponding to particular positions of the rotary unit 2 in the holder 3. To this end, the edge of the bearing surface 22 of the rotary unit 2 is provided with an annular raised portion 23, which is interrupted at defined positions by recesses 24*a* to 24*d*. Latching in place of the rotary unit 2 is achieved by means of the clip 32*a*, which may engage in the recesses 24*a* to 24*d* and fix the rotary unit 2. To identify the clip 32*a*, it is provided with an arrow-type marking 33. The recesses 24*a* to 24*d* also have additional markings identifying the contactable ribbon cable conductor spacings to which they may be adjusted. For a detailed representation of the latching means, reference may also be made to FIG. 5.

The holder 3 of the contacting device 4 may be placed in a predetermined position on a receptacle 5, which receives the cable to be contacted. The receptacle 5 has two latching elements 51*a* and 51*b* in the form of hooks, which may be latched into corresponding recesses in the holder 3. Latching of the hooks secures the receptacle 5 against unintentional detachment.

Figure 4:
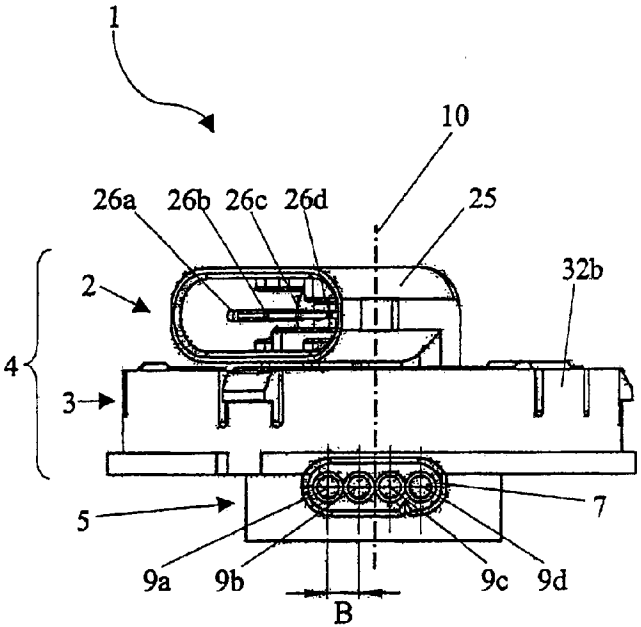
FIG. 4 is a side view of the assembled connector according to the invention, which contacts a ribbon cable.

FIG. 4 is a side view of the assembled connector 1 according to the invention, which contacts a ribbon cable 7. For contacting, the rotary unit 2 is turned to a desired latched position, which corresponds to a defined conductor spacing of a cable inserted in the receptacle, and then placed on the receptacle 5, wherein the piercing contacts penetrate the individual conductors of the ribbon cable and produce an electrical contact.

The position shown in the Figure of the rotary unit 2 and thus of the piercing contacts, and the contacted ribbon cable 7 correspond to the schematic representation in FIG. 2. Since the axis of rotation 10 extends centrally between the piercing contacts, centred orientation of the cable 7 relative to this axis 10 is also necessary, in order to avoid mis- or noncontacting of the conductors 9*a* to 9*d*. Centred orientation could be achieved, for example, by lateral guide clamps in the receptacle, which fix an inserted cable in the required position. Inserts of different widths which may be inserted in the receptacle are also feasible, as are different receptacles for different width cables.

Figure 5:
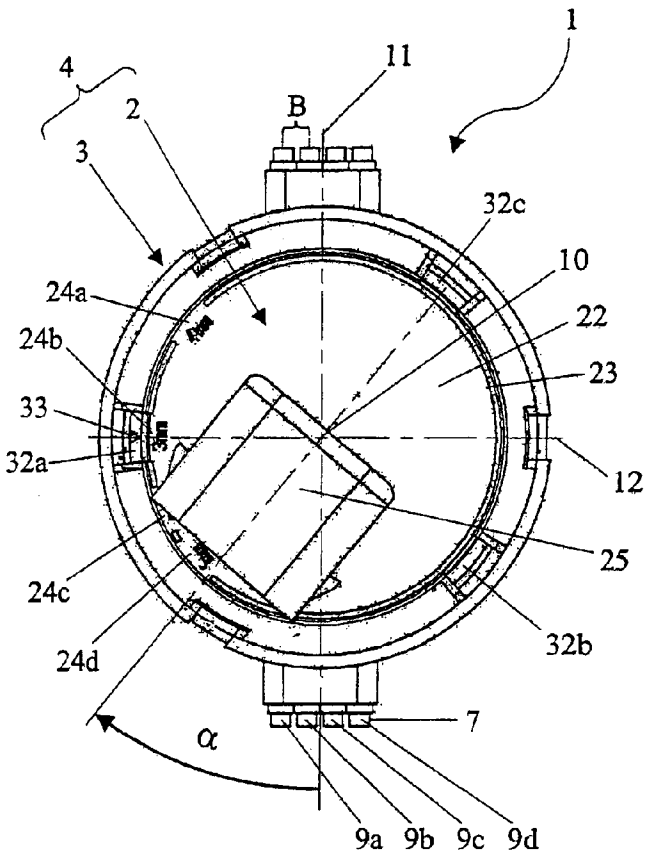
FIG. 5 is a plan view of the connector according to the invention, as shown in FIG. 4.

FIG. 5 is a view from above of the connector 1 according to the invention, corresponding to FIG. 4. This representation clearly shows the latching means of the contacting device 4 consisting of the annular raised portion 23, provided with recesses 24*a* to 24*d*, on the bearing surface 22 of the rotary unit 2 and the clip 32*a* comprising an arrow-type marking 33.

When the rotary unit 2 is in the starting position, corresponding to an angle of rotation of zero, the connector 1 is suitable for contacting a cable with conductor spacing of four millimeters, which matches the mutual spacing of the piercing contacts.

In the illustrated latched position of the rotary unit 2, with an angle of rotation $\alpha$ of approximately 40°, the ribbon cable 7 with a conductor spacing B of three millimeters is contacted. Latching positions appropriate for still smaller conductor spacings of two and one millimeters are provided.

FIG. 6 shows a further schematic representation from above, corresponding to FIG. 2, of the line of piercing contacts 21*a* to 21*d* rotated by an angle $\alpha$, said piercing contacts contacting the conductors 9*a* to 9*d* of the ribbon cable 7 at the conductor spacing B. In contrast to FIG. 2, the axis of rotation 10 is offset laterally relative to the piercing contacts 21*a* to 21*d*, on the axis defined by the line of piercing contacts 21*a* to 21*d*.

Figure 7:
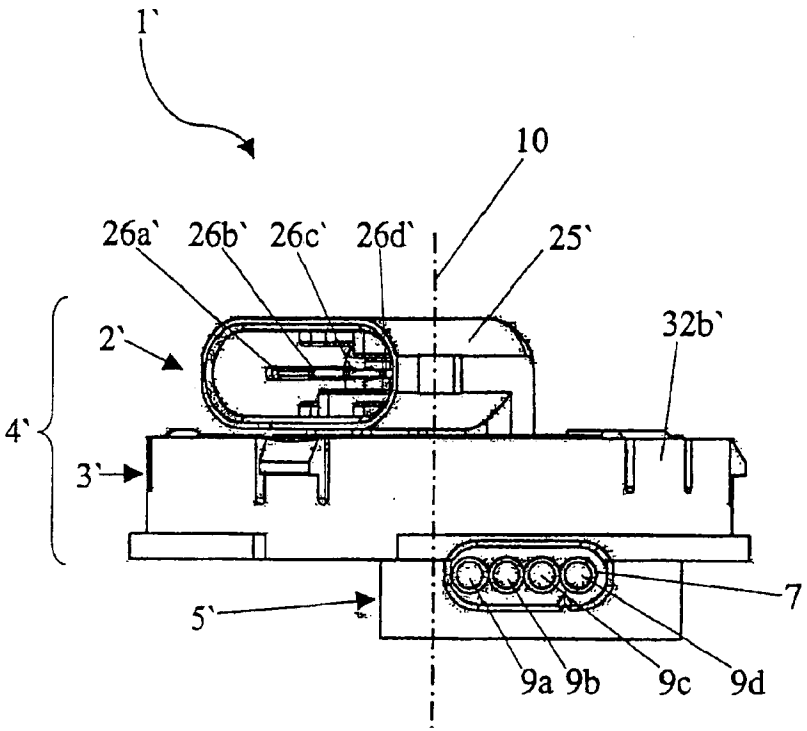
FIG. 7 is a side view of a further embodiment of a connector according to the invention, the piercing contacts of which are arranged offset laterally relative to the axis of rotation.

FIG. 7 is a side view of a further embodiment of a connector 1' according to the invention, which contacts the ribbon cable 7. In contrast to the embodiment illustrated in FIGS. 3 to 5, the piercing contacts are here offset laterally relative to the axis of rotation 10. The position shown in the Figure of the rotary unit 2' and thus of the piercing contacts corresponds to the schematic arrangement illustrated in FIG. 6.

The connector 1' has the advantage that a cable inserted into the receptacle 5' does not have to be centred, since the cable has merely to be positioned against the side wall, located in the area of the axis of rotation 10, of the receptacle 5'. For additional security, the receptacle 5' may optionally be equipped with a lateral guide clamp exerting pressure in the direction of the axis of rotation 10.

What is claimed is:

1. A connector for contacting a conductor of a cable, the connector comprising:

a receptacle for receiving the cable; and a contacting device adapted to be placed on the receptacle and having at least one piercing contact for contacting the conductor of the cable, the contacting device being adapted to be placed on the receptacle such that the piercing contact comes to lie in a freely selectable position in the receptacle, in order to contact the conductor of the cable received in the receptacle, wherein: the contacting device comprises a plurality of piercing contacts arranged in a line with constant spacing for contacting a corresponding number of equally spaced conductors of a ribbon cable, the line of piercing contacts being adapted to be oriented relative to the receptacle such that the spacing between the piercing contacts in a direction across the ribbon cable corresponds exactly to the spacing between the conductors in the ribbon cable; the contacting device is in two parts and comprises a holder, adapted to be placed on the receptacle in a predetermined position, and a rotary unit mounted rotatably in the holder and having the piercing contacts arranged thereon; and the contacting device has markings thereon identifying particular positions of the rotary unit relative to the holder.

2. A connector for contacting a conductor of a cable, the connector comprising:

a receptacle for receiving the cable; and a contacting device adapted to be placed on the receptacle and having at least one piercing contact for contacting the conductor of the cable, the contacting device being adapted to be placed on the receptacle such that the piercing contact comes to lie in a freely selectable position in the receptacle, in order to contact the conductor of the cable received in the receptacle, wherein: the contacting device comprises a plurality of piercing contacts arranged in a line with constant spacing for contacting a corresponding number of equally spaced conductors of a ribbon cable, the line of piercing contacts being adapted to be oriented relative to the receptacle such that the spacing between the piercing contacts in a direction across the ribbon cable corresponds exactly to the spacing between the conductors in the ribbon cable; the contacting device is in two parts and comprises a holder, adapted to be placed on the receptacle in a predetermined position, and a rotary unit mounted rotatably in the holder and having the piercing contacts arranged thereon; and the contacting device comprises a latching means for fixing the rotary unit in particular positions in the holder.

* * * * *